US005534885A

United States Patent [19]

Saitoh

[11] Patent Number: 5,534,885

[45] Date of Patent: Jul. 9, 1996

[54] CIRCUIT FOR DRIVING LIQUID CRYSTAL DEVICE

[75] Inventor: Sei Saitoh, Tokyo, Japan

[73] Assignee: NEC Corporation, Tokyo, Japan

[21] Appl. No.: 162,734

[22] Filed: Dec. 2, 1993

[30] Foreign Application Priority Data

Dec. 2, 1992 [JP] Japan ..... 4-349887

[51] Int. Cl.[6] ..... G09G 3/36

[52] U.S. Cl. ..... 345/100; 345/98; 345/89

[58] Field of Search ..... 345/89, 94, 98, 345/99, 100, 97, 148, 92, 90, 87

[56] References Cited

U.S. PATENT DOCUMENTS 5,075,683 12/1991 Ghis ..... 345/148

FOREIGN PATENT DOCUMENTS

A0458169 11/1991 European Pat. Off. .
A0478386 4/1992 European Pat. Off. .
478386A2 4/1992 European Pat. Off. .
A0488516 6/1992 European Pat. Off. .

OTHER PUBLICATIONS

K. Takahara et al.; "16–Level Gray–Scale Driver Architecture and Full–Color Driving for TFT–LCD"; IEEE, IDRC 1991, pp. 115–118.

Eurpoean Search Report.

IBM Technical Disclosure Statement, vol. 33, No. 6B, Nov. 1990, New York U.S., pp. 384–385, "Driving Method for TFT/LCD Grayscale".

*Primary Examiner*—Curtis Kuntz
*Assistant Examiner*—Vivian W. Chang
*Attorney, Agent, or Firm*—Whitham, Curtis, Whitham & McGinn

[57] ABSTRACT

A liquid crystal display driving circuit comprises a plurality of transfer gates having their one end connected in common to a source line of a liquid crystal display panel and their other end connected to a plurality of driving voltages, respectively, for supplying a different voltage to the source line. A control circuit receives an image input data for selectively turning on the transfer gates, for the purpose of realizing a multiple gray scale display. The control circuit is configured to turn on one transfer gate selected from the plurality of transfer gates during a first period of one display period, and then, to maintain the turned-on condition of the selected transfer gate during the remaining period of one display period, or to simultaneously turn on two transfer gates which are selected from the plurality of transfer gates and which include the selected transfer gate during the remaining period of one display period.

23 Claims, 17 Drawing Sheets

FIGURE 2 PRIOR ART

| IMAGE INPUT DATA $V_i$ | | | | DRIVE OUTPUT VOLTAGE $V_0$ | TURNED-ON OUTPUT TRANSISTOR |
|---|---|---|---|---|---|
| $D_{n-1}$ | ····· | $D_1$ | $D_0$ | | |
| 0 | ····· | 0 | 0 | $V_1$ | $Q_{11}$ |
| 0 | ····· | 0 | 1 | $V_2$ | $Q_{21}$ |
| 0 | ····· | 1 | 0 | $V_3$ | $Q_{31}$ |
| 0 | ····· | 1 | 1 | $V_4$ | $Q_{41}$ |
| ⋮ | | ⋮ | ⋮ | ⋮ | ⋮ |
| 1 | ····· | 1 | 1 | $V_m$ | $Q_{m1}$ |

FIGURE 4

| IMAGE INPUT DATA $V_i$ | | | | DRIVE OUTPUT VOLTAGE $V_0$ | TURNED-ON OUTPUT TRANSISTOR |
|---|---|---|---|---|---|
| $D_{n-1}$ | ····· | $D_1$ | $D_0$ | | |
| 0 | ····· | 0 | 0 | $V_1$ | $Q_{11}$ |
| 0 | ····· | 0 | 1 | $\simeq \frac{V_1+V_2}{2}$ | $Q_{11}$ AND $Q_{21}$ |
| 0 | ····· | 1 | 0 | $V_2$ | $Q_{21}$ |
| 0 | ····· | 1 | 1 | $\simeq \frac{V_2+V_3}{2}$ | $Q_{21}$ AND $Q_{31}$ |
| | | | | $V_3$ | $Q_{31}$ |
| ⋮ | | ⋮ | ⋮ | ⋮ | ⋮ |
| 1 | ····· | 0 | 1 | $\simeq \frac{V_{m+1}+V_m}{2}$ | $Q_{m-1}$ AND $Q_m$ |
| 1 | ····· | 1 | 0 | $V_m$ | $Q_m$ |

FIGURE 7

| OUTPUT VOLTAGE | IMAGE INPUT DATA | | | | | STATUS OF TRANSFER GATE | | | | | | | OUTPUT OF DECODER | | | | |
|---|---|---|---|---|---|---|---|---|---|---|---|---|---|---|---|---|---|
| | MAIN BIT | | | | SUB BIT | | | | | | | | | | | | |
| | $D_{M3}$ | $D_{M2}$ | $D_{M1}$ | $D_{M0}$ | $D_{H0}$ | $TG_{M16}$ | $TG_{M15}$ | $TG_{M14}$ | | $TG_{M2}$ | $TG_{M1}$ | $TG_{M0}$ | $O_{M15}$ | $O_{M14}$ | | $O_{M1}$ | $O_{M0}$ |
| $V_0$ | 0 | 0 | 0 | 0 | 0 | OFF | OFF | OFF | | OFF | OFF | ON | OFF | OFF | | OFF | ON |
| $\frac{V_0+V_1}{2}$ | 0 | 0 | 0 | 0 | 1 | ↓ | ↓ | ↓ | | ↓ | ON | ↓ | ↓ | ↓ | | ↓ | ↓ |
| $V_1$ | 0 | 0 | 0 | 1 | 0 | ↓ | ↓ | ↓ | | ↓ | ↓ | OFF | ↓ | ↓ | | OFF | OFF |
| $\frac{V_1+V_2}{2}$ | 0 | 0 | 0 | 1 | 1 | ↓ | ↓ | ↓ | | ON | ↓ | ↓ | ↓ | ↓ | | ↓ | ↓ |
| $V_2$ | 0 | 0 | 1 | 0 | 0 | ↓ | ↓ | ↓ | | ↓ | OFF | ↓ | ↓ | ↓ | | OFF | ↓ |
| $V_{14}$ | 1 | 1 | 1 | 0 | 1 | OFF | OFF | ON | | OFF | OFF | OFF | OFF | ON | | OFF | OFF |
| $\frac{V_{14}+V_{15}}{2}$ | 1 | 1 | 1 | 0 | 0 | ↓ | ON | ↓ | | ↓ | ↓ | ↓ | ↓ | ↓ | | ↓ | ↓ |
| $V_{15}$ | 1 | 1 | 1 | 1 | 0 | ↓ | ↓ | OFF | | ↓ | ↓ | ↓ | ON | OFF | | ↓ | ↓ |
| $\frac{V_{15}+V_{16}}{2}$ | 1 | 1 | 1 | 1 | 1 | ON | ↓ | ↓ | | ↓ | ↓ | ↓ | ↓ | ↓ | | ↓ | ↓ |

FIGURE 14

| INPUT | | | | OUTPUT | |
|---|---|---|---|---|---|
| $H_1$ | $H_0$ | $M_n$ | $M_{n-1}$ | $TG_{Mn}$ | $TG_{Hn}$ |
| 0 | 0 | 0 | 0 | 0 | 0 |
| | | 0 | 1 | 0 | 0 |
| | | 1 | 0 | 1 | 0 |
| | | 1 | 1 | 1 | 0 |
| 0 | 1 | 0 | 0 | 0 | 0 |
| | | 0 | 1 | 0 | 1 |
| | | 1 | 0 | 1 | 1 |
| | | 1 | 1 | 1 | 1 |
| 1 | 0 | 0 | 0 | 0 | 0 |
| | | 0 | 1 | 1 | 1 |
| | | 1 | 0 | 1 | 1 |
| | | 1 | 1 | 1 | 1 |
| 1 | 1 | 0 | 0 | 0 | 0 |
| | | 0 | 1 | 1 | 1 |
| | | 1 | 0 | 0 | 1 |
| | | 1 | 1 | 1 | 1 |

FIGURE 19

| OUTPUT VOLTAGE | IMAGE INPUT DATA | | | | | | STATUS OF TRANSFER GATE | | | | | | | | | |
|---|---|---|---|---|---|---|---|---|---|---|---|---|---|---|---|---|
| | MAIN BIT | | | | SUB BIT | | MAIN TRANSFER GATE | | | | | SUB TRANSFER GATE | | | | |
| | $D_{M3}$ | $D_{M2}$ | $D_{M1}$ | $D_{M0}$ | $D_{H1}$ | $D_{H0}$ | $TG_{M16}$ | $TG_{M15}$ | $TG_{M2}$ | $TG_{M1}$ | $TG_{M0}$ | $TG_{H16}$ | $TG_{H15}$ | $TG_{H2}$ | $TG_{H1}$ | $TG_{H0}$ |
| $V_0$ | 0 | 0 | 0 | 0 | 0 | 0 | OFF | OFF | OFF | OFF | ON | OFF | OFF | OFF | OFF | OFF |
| $\frac{3V_0+V_1}{4}$ | 0 | 0 | 0 | 0 | 0 | 1 | ↓ | ↓ | ↓ | ↓ | ↓ | ↓ | ↓ | ↓ | ON | ON |
| $\frac{V_0+V_1}{2}$ | 0 | 0 | 0 | 0 | 1 | 0 | ↓ | ↓ | ↓ | ON | ↓ | ↓ | ↓ | ↓ | ↓ | ↓ |
| $\frac{V_0+3V_1}{4}$ | 0 | 0 | 0 | 0 | 1 | 1 | ↓ | ↓ | ↓ | ↓ | OFF | ↓ | ↓ | ↓ | ↓ | ↓ |
| $V_1$ | 0 | 0 | 0 | 1 | 0 | 0 | OFF | OFF | OFF | ON | OFF | OFF | OFF | OFF | OFF | OFF |
| $\frac{3V_1+V_2}{4}$ | 0 | 0 | 0 | 1 | 0 | 1 | ↓ | ↓ | ↓ | ↓ | ↓ | ↓ | ↓ | ON | ON | ↓ |
| $\frac{V_1+V_2}{2}$ | 0 | 0 | 0 | 1 | 1 | 0 | ↓ | ↓ | ON | ↓ | ↓ | ↓ | ↓ | ↓ | ↓ | ↓ |
| $\frac{V_1+3V_2}{4}$ | 0 | 0 | 0 | 1 | 1 | 1 | ↓ | ↓ | ↓ | OFF | ↓ | ↓ | ↓ | ↓ | ↓ | ↓ |

FIGURE 20

| OUTPUT VOLTAGE | IMAGE INPUT DATA | | | | | | STATUS OF TRANSFER GATE | | | | | | | | | |
|---|---|---|---|---|---|---|---|---|---|---|---|---|---|---|---|---|
| | MAIN BIT | | | | SUB BIT | | MAIN TRANSFER GATE | | | | | SUB TRANSFER GATE | | | | |
| | $D_{M3}$ | $D_{M2}$ | $D_{M1}$ | $D_{M0}$ | $D_{H1}$ | $D_{H0}$ | $TG_{M16}$ | $TG_{M15}$ | $TG_{M2}$ | $TG_{M1}$ | $TG_{M0}$ | $TG_{H16}$ | $TG_{H15}$ | $TG_{H2}$ | $TG_{H1}$ | $TG_{H0}$ |
| $V_2$ | 0 | 0 | 1 | 0 | 0 | 0 | OFF | OFF | ON | OFF | OFF | OFF | OFF | OFF | OFF | OFF |
| $\frac{3V_2+V_3}{4}$ | 0 | 0 | 1 | 0 | 0 | 1 | ↓ | ↓ | ↓ | ↓ | ↓ | ↓ | ↓ | ON | ↓ | ↓ |
| $\frac{V_2+V_3}{2}$ | 0 | 0 | 1 | 0 | 1 | 0 | ↓ | ↓ | ↓ | ↓ | ↓ | ↓ | ↓ | ↓ | ↓ | ↓ |
| $\frac{V_2+3V_3}{4}$ | 0 | 0 | 1 | 0 | 1 | 1 | ↓ | ↓ | OFF | ↓ | ↓ | ↓ | ↓ | ↓ | ↓ | ↓ |
| $V_3$ | 0 | 0 | 1 | 1 | 0 | 0 | OFF | OFF | OFF | OFF | OFF | OFF | OFF | OFF | OFF | OFF |
| | | | | | | | | | | | | | | | | |
| $V_{15}$ | 1 | 0 | 0 | 0 | 0 | 0 | OFF | ON | OFF | OFF | OFF | OFF | OFF | OFF | OFF | OFF |
| $\frac{3V_{15}+V_{16}}{4}$ | 1 | 0 | 0 | 0 | 0 | 1 | ↓ | ↓ | ↓ | ↓ | ↓ | ON | ON | ↓ | ↓ | ↓ |
| $\frac{V_{15}+V_{16}}{2}$ | 1 | 0 | 0 | 0 | 1 | 0 | ON | ↓ | ↓ | ↓ | ↓ | ↓ | ↓ | ↓ | ↓ | ↓ |
| $\frac{V_{15}+3V_{16}}{4}$ | 1 | 0 | 0 | 0 | 1 | 1 | ↓ | OFF | ↓ | ↓ | ↓ | ↓ | ↓ | ↓ | ↓ | ↓ |

CIRCUIT FOR DRIVING LIQUID CRYSTAL DEVICE

BACKGROUND OF THE INVENTION

1. Field of the Invention

The present invention relates to a liquid crystal device driving circuit, and more specifically, to a circuit for driving a liquid crystal display panel capable of displaying an image with a multiple tone level.

2. Description of Related Art

As a liquid crystal device driving circuit for generating a source voltage driving a liquid crystal display panel typified by an active matrix type, a circuit for enabling a multiple tone or gray scale image on the order of eight gray scale levels has been implemented in the form of a LSI (large scale integrated circuit) and is now under mass production and widely used.

FIG. 1 is a block diagram showing one example of a conventional liquid crystal device driving circuit. In order to display a multiple gray scale image in a liquid crystal display panel, it is required to supply a drive voltage corresponding to a required luminance, from drive voltage output terminals T1 to Tk of a transistor switch circuit 3 to corresponding source lines of the liquid crystal display panel.

For this purpose, the drive circuit includes "k" stages of "n"-bit shift registers 15*a* to 15*k* receiving an image input data Vi from an image data input terminal, a corresponding number of "n"-bit latches 16*a* to 16*k* each for latching the "n"-bit data of a corresponding one of the "n"-bit shift registers 15*a* to 15*k*, and a corresponding number of selector circuits 14*a* to 14*k* for selectively turning on output transistors Q11 to Qmk included in the transistor switch circuit 3 on the basis of an output of the latches 16*a* to 16*k*.

Namely, an "n"-bit digital image input data Vi indicative of "m" gray scale levels is supplied from the image data input terminal 7, and shifted and stored in the "n"-bit shift registers 15*a* to 15*k* in response to a clock pulse Vc applied to a clock input terminal 1. In response to a latch pulse Vr applied to a latch pulse input terminal 2, the data stored in each of the registers is transferred to a corresponding one of the "n"-bit latches 16*a* to 16*k*.

The "n"-bit data latched in each latch is decoded by a corresponding one of the selector circuits 14*a* to 14*k* to the effect that one transistor of the first "m" output stage transistors Q11 to Qm1 connected to the drive output terminal T1 of the transistor switch circuit 3 is turned on, and one transistor of the "k"th "m" output stage transistors Q1k to Qmk connected to the drive output terminal Tk is turned on. With this arrangement, voltages V1, V2, . . . , $V_m$ corresponding to drain voltage terminals 8*a* to 8*m* of "m" gray scale levels are supplied, so that voltages of "m" gray scale levels are supplied to an external liquid crystal display.

For example, assuming that the image input data Vi is composed of digital signals $D_0$, $D_1$, . . . , $D_{n-1}$, the voltage Vo appearing on the drive output terminal T1 is as shown in FIG. 2.

In this conventional liquid crystal device driving circuit, if the number of gray scale levels is increased, it is required to connect low-impedance large-current-capacity, external voltage supplies, and therefore, when the driving circuit is assembled in the liquid crystal display panel, wiring conductors must be thickened and the overall assembly of the liquid crystal display panel correspondingly becomes Large. In addition, with an increase in the number of pixels in the liquid crystal display panel, the driving circuit is required to have a low impedance.

Furthermore, if the number of gray scale levels is increased, when a buffer circuit having a low impedance and a large output capacity is implemented on the same semiconductor substrate, the chip size becomes extremely large, and therefore, the driving circuit becomes costly. Because of this reason, most of this type of liquid crystal display driver is on the order of 8 gray scale levels to 16 gray scale levels. For a full-color display, however, the liquid crystal display panel required to have a gray scale of 64 levels or more is going to be marketed.

Under this circumstance, in order to increase the number of gray scale levels, the present applicant has proposed one approach, which is disclosed in the specification of Japanese Patent Application No. Hei 4-80176. This approach is featured, not only by turning on only one of the transistors $Q_{11}$ to $Q_{m1}$ of the transistor switch circuit as in the circuit shown in FIG. 1, but also by simultaneously turning on a plurality of transistors of the transistors $Q_{11}$ to $Q_{m1}$, so that the voltage outputted from the drive voltage output terminal T1 has a multiple voltage level.

FIG. 3 is a block diagram of this liquid crystal display driving circuit, and in FIG. 3, the elements similar to those shown in FIG. 1 are given the same Reference Numerals.

For this purpose, the drive circuit includes "k" stages of "(n+1)"-bit shift registers 5*a* to 5*k* receiving an image input data from an image data input terminal 7, a corresponding number of "(n+1)"-bit latches 6*a* to 6*k* each for latching the "(n+1)"-bit data of a corresponding one of the "(n+1)"-bit shift registers 5*a* to 5*k*, and a corresponding number of selector circuits 4*a* to 4*k* for selectively turning on output transistors Q11 to Qmk included in the transistor switch circuit 3 by decoding the data outputted from the latches 5*a* to 6*k*. With a selective turning-on control of the transistors Q11 to Qmk in the transistor switch circuit 3, a drive output voltage Vo is generated on each of the drive voltage output terminals $T_1$ to $T_k$.

Namely, a digital image input data Vi formed of "(n+1)" bits ($D_0$, $D_1$, . . . , $D_n$) is supplied from the input terminal 7, and sequentially shifted and stored in the "(n+1)"-bit shift registers 5*a* to 5*k* in response to a clock pulse Vc. In response to a latch pulse Vr, the data stored in each of the registers is transferred to a corresponding one of the "(n+1)"-bit latches 6*a* to 6*k*. The "(n+1)"-bit data latched in each latch is decoded by a corresponding one of the selector circuits 4*a* to 4*k* to the effect that either one transistor or two transistors of the first "m" output stage transistors Q11 to Qm1 connected to the drive output terminal T1 of the transistor switch circuit 3 is simultaneously turned on, and either one transistor or two transistors of the "k"th "m" output stage transistors Q1k to Qmk connected to the drive output terminal Tk is simultaneously turned on. With this arrangement, voltages V1, V2, . . . , $V_m$ corresponding to drain voltage terminals 8*a* to 8*m* of "m" gray scale levels or their combined voltages are generated.

For example, assuming that the "(n+1)"-bit image input data Vi is composed of digital signals $D_0$, $D_1$, . . . , $D_n$, the voltage Vo appearing on the drive output terminal T1 is as shown in FIG. 4.

Here, when the digital signals ($D_0$, $D_1$, . . . , $D_n$)=(0, 0, . . . , 0), only the output transistor $Q_{11}$ is turned on by the associated selector circuit 4*a*, so that the output voltage $V_1$ is outputted. When the digital signals ($D_0$, $D_1$, . . . , $D_n$)=(0, 0, . . . , 1), the output transistors $Q_{11}$ and $Q_{21}$ are simultaneously turned on by the associated selector circuit 4*a*. At this time, assuming that all the output transistors $Q_{11}$ to $Q_{mk}$ have the same current driving capacity, the output voltage Vo becomes $Vo=(V_1+V_2)/2$.

Namely, the output transistors are equally formed on the same silicon substrate, the characteristics of the output transistors $Q_{11}$ to $Q_{mk}$ have only a little variation in a relative small zone within the same chip, even if it greatly varies from one manufacturing lot to another and from one wafer to another. Namely, the variation of the transistors is on the order of 10% at maximum. Therefore, it becomes $Vo\approx(V_1+V_2)/2$, depending on a ratio in on-resistance ratio of the output transistors $Q_{11}$ and $Q_{21}$. Furthermore, in order to realize a multiple gray scale level in the liquid crystal display panel, the intervals of voltage steps are obtained by dividing the voltage of about 3 V to 4 V applied to the liquid crystal display, by the number of required gray scale levels.

For example, if 16 gray scale levels are required, the voltage steps having the voltage intervals on the order of 0.25 V (=4 V/16) are applied to the liquid crystal display panel. Accordingly, assuming that when the output transistors $Q_{11}$ and $Q_{21}$ are simultaneously turned on, a relative variation between the output transistors $Q_{11}$ and $Q_{21}$ is 10%, if $(V_1-V_2)=0.25$ V, the variation of the output voltage Vo is on the order of 25 mV. This is not so significant in an image displayed on the liquid crystal display panel.

Similarly, either one or two of each "m" transistors of the output transistors $Q_{1k}$ to $Q_{mk}$ are simultaneously turned on by the associated selector circuit 4*k*. Thus, (2m−1) different output drive voltages can be obtained from the "m" different voltages Vm supplied from the voltage supply terminals 8*a* to 8*m*.

Incidentally, for convenience, the switching elements of the transistor switch circuit 3 have been composed of the transistors $Q_{11}$ to $Q_{mk}$. However, even if the transistors are replaced with transfer gates, the same effect can be obtained.

In the above mentioned liquid crystal device driving circuit, when the output transistors $Q_{11}$ and $Q_{21}$ are simultaneously turned on, since the output impedance of the output transistors $Q_{11}$ and $Q_{mk}$ is on the order of about 10KΩ to about 5KΩ, the current flowing through each output becomes on the order of about 50 μA to about 25 μA (=0.25 V/10KΩ to 0.25 V/5KΩ. In an LCD driver LSI in which a driving circuit for the liquid crystal display panel is formed on a silicon substrate, in the case of the output number "k"=192, the current becomes 4.8 mA to 9.6 mA, and therefore, the consumed electric power correspondingly becomes 1.2 mW to 2.4 mW (=(4.8 mA to 9.6 mA)×0.25 V). This value is almost no problem as the LCD driver LSI.

However, the liquid crystal panel uses at least 10 LCD driver LSIs each having the 192 outputs, and therefore:, a voltage supply for the liquid crystal device driving circuit requires at least a current corresponding to the 10 LCD driver LSIs, namely, a current supplying capacity of 48 mA to 96 mA. If the voltage supply is 20 V, there is required a large consumed electric power of 0.96 W to 1.92 W (=(48 mA to 96 mA)×20 V).

Furthermore, the conventional liquid crystal device driving circuit can realize the (2m−1) gray scale levels, by simultaneously turning on any two transistors of each "m" transistors of the output transistors $Q_{1k}$ to $Q_{mk}$ by action of the selector circuit 4*k*. However, if the potential difference between the simultaneously turned-on transistors is large, a very large current is required for the conventional liquid crystal device driving circuit, and therefore, the consumed electric power correspondingly becomes large. This is not practical.

SUMMARY OF THE INVENTION

Accordingly, it is an object of the present invention to provide a liquid crystal device driving circuit which has overcome the above mentioned defect of the conventional ones.

Another object of the present invention is to provide a driving circuit for a multiple gray scale liquid crystal device, with a reduced number of external voltage supplies and with a reduced consumed electric power.

The above and other objects of the present invention are achieved in accordance with the present invention by a liquid crystal display driving circuit comprising a plurality of switching means having their one end connected in common to a source line of a liquid crystal display panel and their other end connected to a plurality of driving voltages, respectively, for supplying a different voltage to the source line, and a control means receiving an image input data for selectively turning on the switching means, for the purpose of realizing a multiple gray scale display, the control means including means for turning on one switching means selected from the plurality of switching means during a first period of one display period, and for simultaneously turning on the one switching means or a plurality of switching means selected from the plurality of switching means during a second period of one display period.

The above and other objects, features and advantages of the present invention will be apparent from the following description of preferred embodiments of the invention with reference to the accompanying drawings.

BRIEF DESCRIPTION OF THE DRAWINGS

FIG. 2 is a table showing the relation between the image input data, the driving output voltage and the switching transistors in the circuit shown in FIG. 1;

FIG. 4 is a table showing the relation between the image input data, the driving output voltage and the switching transistors in the circuit shown in FIG. 3;

FIG. 7 is a table showing the relation between the input image data and the output voltage in the liquid crystal device driving circuit shown in FIG. 5;

FIG. 14 is a truth table showing the relation between the inputs and the outputs of the control circuit shown in FIG. 13;

FIGS. 19 and 20 are tables for illustrating operation of the liquid crystal device driving circuit shown in FIG. 9.

DESCRIPTION OF THE PREFERRED EMBODIMENTS

Now, embodiments of the present invention will be described with reference to the drawings.

Figure 1:
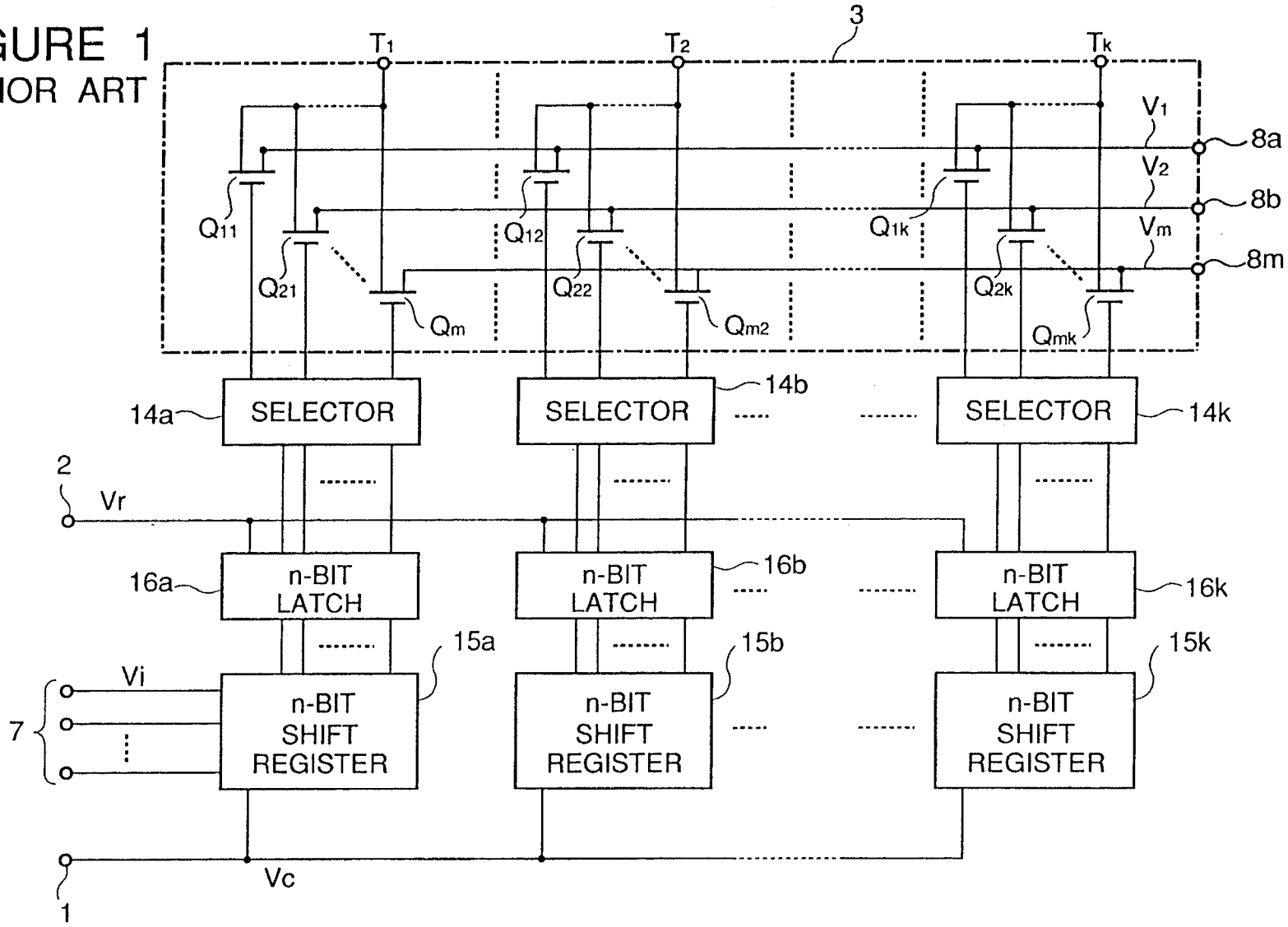
FIGURE 1 PRIOR ART
FIG. 1 is a block diagram showing one example of a conventional liquid crystal device driving circuit.
Figure 3:
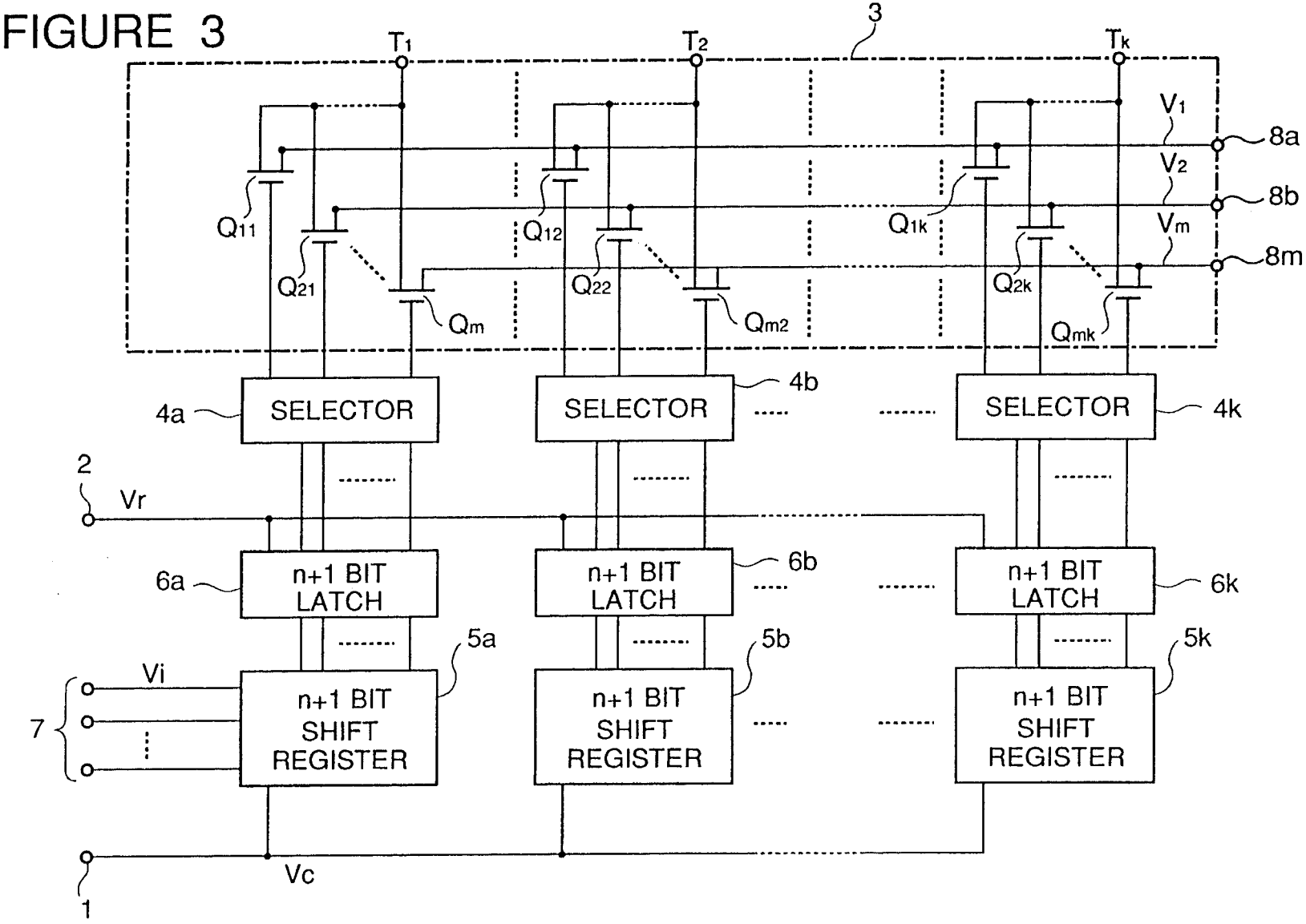
FIG. 3 is a block diagram of another liquid crystal display driving circuit.
Figure 5:
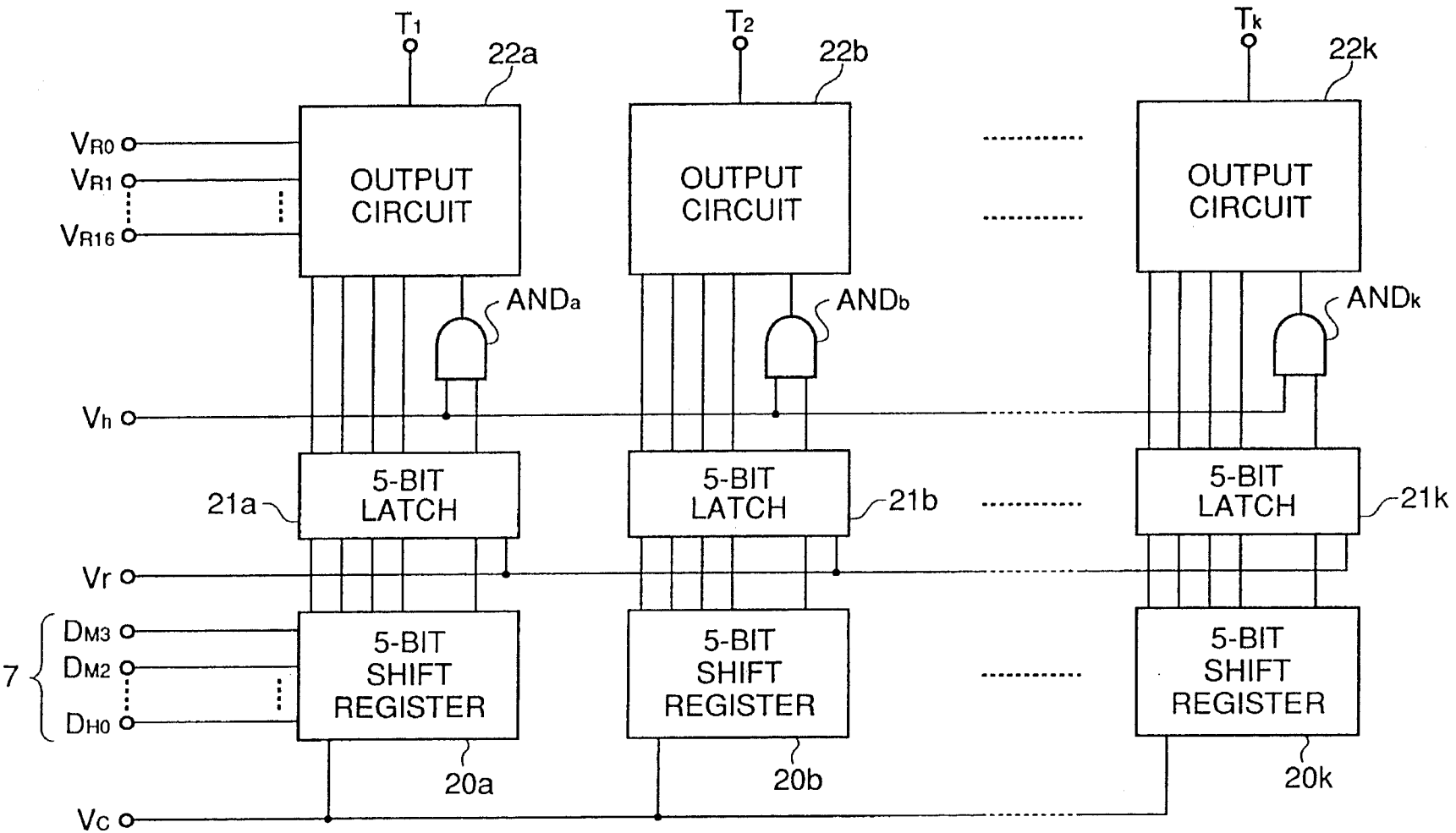
FIG. 5 is a block diagram of one embodiment of the liquid crystal device driving circuit in accordance with the present invention.

Referring to FIG. 5, there is shown a block diagram of one embodiment of the liquid crystal device driving circuit in accordance with the present invention. As one example, the shown embodiment is configured to receive image data of 5 bits ($D_{M3}$, $D_{M2}$, $D_{M1}$, $D_{M0}$, $D_{H0}$) and to generate driving voltages of $2^5$=32 gray scale levels. In addition, the most significant bit of the 5-bit image data is labelled "$D_{M3}$", and the least significant bit of the 8-bit image data is labelled "$D_{H0}$". For convenience of description, the bits "$D_{M3}$" to "$D_{M0}$" of the 5-bit image data are called "main bits", and the bit "$D_{H0}$" of the 5-bit image data is called a "sub (interpolating) bit".

The shown drive circuit includes "k" stages of 5-bit shift registers 20*a* to 20*k* receiving an image input data from an image data input terminal 7, a corresponding number of 5-bit latches 21*a* to 21*k* each for latching the 5-bit data of a corresponding one of the 5-bit shift registers 20*a* to 20*k*, external gray scale level voltages $V_{R0}$, $V_{R1}$, . . . , $V_{R16}$ corresponding to 16 gray scale levels, a corresponding number of output circuits 22*a* to 22*k* each generating an intermediate voltage between each pair of adjacent voltages of the gray scale level voltages $V_{R0}$, $V_{R1}$, . . . , $V_{R16}$ on the basis of the interpolating bit "$D_{H0}$", and a corresponding number of AND gates AND*a* to AND*k* for controlling the output of the interpolating bit "$D_{H0}$" from the 5-bit latches 21*a* to 21*k* to the output circuits 22*a* to 22*k* on the basis of an output voltage interpolating input Vh.

Figure 6:
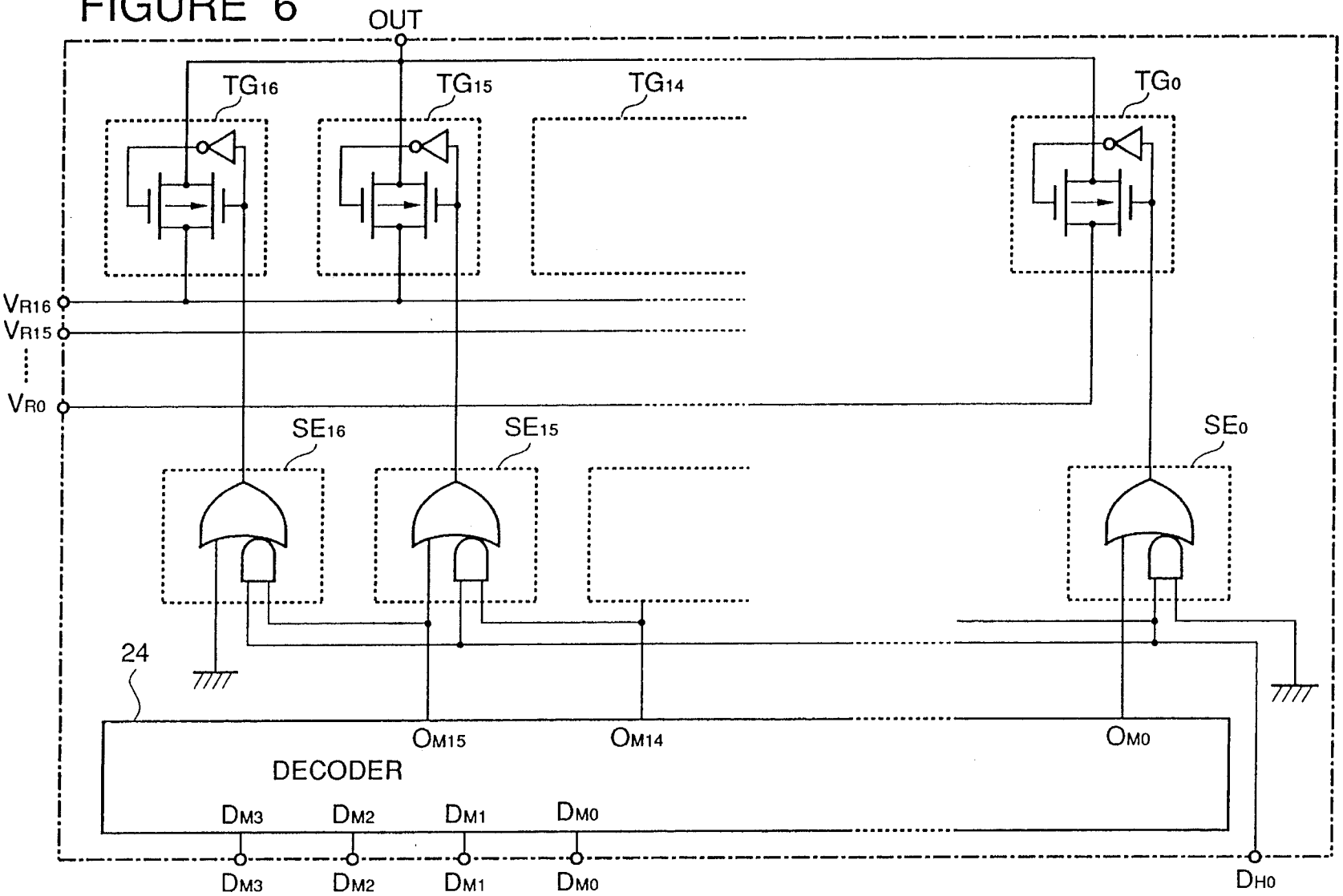
FIG. 6 is a detailed circuit diagram of the output circuit shown in the liquid crystal device driving circuit shown in FIG. 5.

FIG. 6 shows a circuit diagram of the output circuits 22*a* to 22*k*. Each of the output circuits 22*a* to 22*k* includes a decoder 24 receiving the main bits "$D_{M3}$" to "$D_{M0}$" of 4 bits for activating one selection signal, transfer gates $TG_0$ to $TG_{16}$ connected to the external gray scale level voltages $V_{R0}$, $VR_1$, . . . , $V_{R16}$, respectively, and control circuits $SE_0$ to $SE_{16}$ each receiving the interpolating bit "$D_{H0}$" and a corresponding one of outputs $O_{M0}$ to $O_{M16}$ of the decoder 24 for controlling a corresponding one of the transfer gates. Each of the control circuits $SE_0$ to $SE_{16}$ is formed of one AND gate and one OR gate connected as shown.

The 5-bit image input data $D_{M3}$ to $D_{M0}$ and $D_{H0}$ is supplied through the image input terminal 7, and transferred through the 5-bit shift registers 20*a* to 20*k* in response to the clock pulse Vc. In response to the latch pulse Vr, the image input data in the 5-bit shift registers 20*a* to 20*k* is transferred and latched in the 5-bit latches 21*a* to 21*k*. The main bits $D_{M3}$ to $D_{M0}$ of the data latched in each latch are supplied to the decoder 24 of a corresponding output circuit 22*a* to 22*k*, so that an active selection pulse is outputted from one of the outputs $O_{M0}$ to $O_{M16}$ of the decoder in accordance with the content of the main bits $D_{M3}$ m $D_{M0}$, as shown in FIG. 7. In FIG. 7, the label "ON" shows an active condition, and the label "OFF" indicates an inactive condition.

Namely, if ($D_{M3}$, . . . , $D_{M0}$)=(0, 0, 0, 0), the output $O_{M0}$ is "ON" (active), and if ($D_{M3}$, . . . , $D_{M0}$)=(0, 0, 0, 1), the output $O_{M1}$ is "ON" (active). If ($D_{M3}$, . . . , $D_{M0}$)=(1, 1, 1, 1), the output $O_{M15}$ is "ON" (active).

In addition, the sub bit $D_{H0}$ of the data latched in each latch is supplied through the AND gates AND*a* to AND*k* to the control circuits $SE_0$ to $SE_{16}$ of each output circuit 22*a* to 22*k* when the output voltage interpolating input Vh is "1" (high level). When the sub bit $D_{H0}$ is "0", the control circuits $SE_0$ to $SE_{16}$ output the signals received from the outputs $O_{M0}$ to $O_{M16}$ of the decoder, without modification. Namely, only any one of the transfer gates $TG_0$ to $TG_{16}$ is turned on in accordance with the content of the main bits $D_{M3}$ to $D_{M0}$, so that one of the gray scale level voltages $V_{R0}$ to $V_{R16}$ connected to the transfer gates $TG_0$ to $TG_{16}$, respectively, is selected and outputted to an output terminals OUT ($T_1$ to $T_k$).

On the other hand, when the sub bit $D_{H0}$ is "1", the control circuits SEn and SE(n+1) are selected by an active output signal OMn of the decoder 24, so that the transfer gates TGn and TG(n+1) are simultaneously selected. As a result, an intermediate voltage between the gray scale level voltage $V_{Rn}$ connected to the transfer gates $TG_n$ and the gray scale level voltages $V_{R(n+1)}$ connected to the transfer gate $TG_{(n+1)}$ is generated at the output terminal $T_1$ to $T_k$ of the output circuits 22*a* to 22*k*.

Here, assuming that the all the transfer gates $TG_0$ to $TG_{16}$ are constructed to have the same structure and the same on-resistance, the output voltage becomes $\{V_{Rn}+V_{R(n+1)}\}/2$. The function explained until here is completely the same as that of the conventional liquid crystal device driving circuit. Here, the relation between the input image data and the output voltage is as shown in FIG. 7.

Here, when the output voltage interpolating input Vh is "0", the output of the AND gates AND*a* to AND*k* becomes "0", and therefore, only one transfer gate is selected in accordance with the content of the main bits $D_{M3}$ m $D_{M0}$. On the other hand, when the output voltage interpolating input Vh is "1", if the sub bit $D_{H0}$ is "0", one transfer gate is selected in accordance with the content of the main bits $D_{M3}$ to $D_{M0}$, similarly to the case of Vh="0". However, if the sub bit $D_{H0}$ is "1", a gray scale voltage near to an intermediate voltage between a pair of adjacent gray scale voltage supply voltages is selected as mentioned above.

Figure 8:
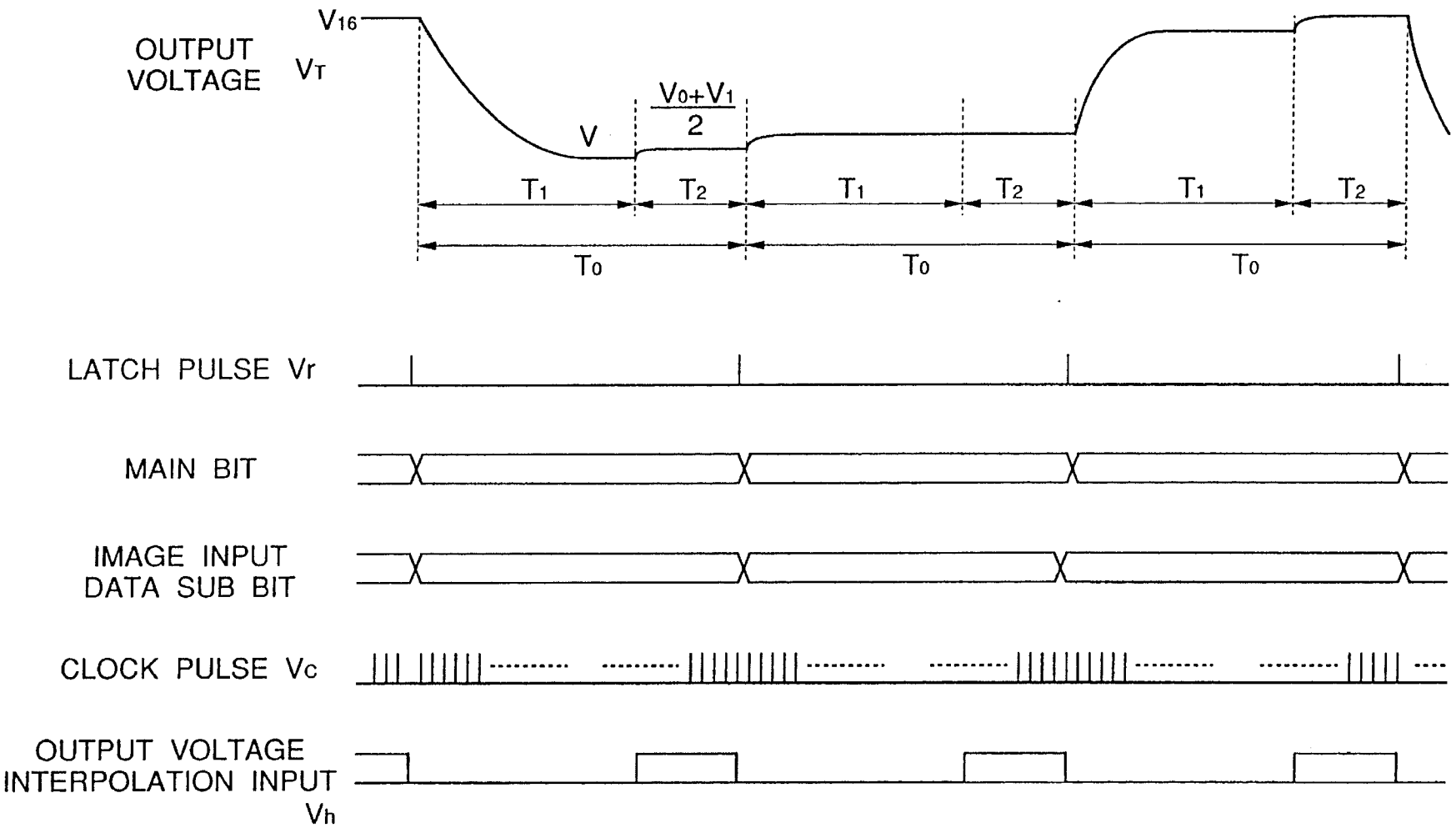
FIG. 8 is a timing chart illustrating an operation of the liquid crystal device driving circuit shown in FIG. 5.

Furthermore, an operation of the embodiment of the liquid crystal device driving circuit will be described with reference to the timing chart of FIG. 8. In an active matrix type liquid crystal display panel, a voltage supplied from a source side liquid crystal device driving circuit is charged through a wiring conductor on the liquid crystal display panel, to a thin film transistor associated with a corresponding pixel on the liquid crystal display panel, during one horizontal scan period $T_0$.

For example, if the data latched in the 5-bit latches 21*a* to 21*k* in response to the latch pulse Vr is ($D_{M3}$, $D_{M2}$, $D_{M1}$, $D_{M0}$, $D_{H0}$)=(0, 0, 0, 0, 1), when the output voltage interpolating input Vh is "0", the transfer gate $TG_0$ is selected in accordance with FIG. 7, so that $V_0$ is outputted, and the display panel is charged $V_0$ during a first partial period $T_1$ of the horizontal scan period $T_0$.

Next, when the output voltage interpolating input Vh becomes "1", the transfer gates $TG_0$ and $TG_1$ are selected in accordance with FIG. 7, so that the voltage of $(V_0+V_1)/2$ is outputted, and the display panel is charged from $V_0$ to $(V_0+V_1)/2$ during a second and final partial period $T_2$ of the horizontal scan period $T_0$. In this case, assuming that the voltage before the charging is $V_{16}$, the voltage is required to change over a full swing range between $V_0$ and $V_{16}$, and therefore, a sufficient time period $T_1$ is required to change over the full swing range. During the time period $T_2$, it is sufficient if the voltage changes only from $V_0$ to $(V_0+V_1)/2$, namely, over 1/32 of the full swing range. Accordingly, the time period $T_2$ can be sufficiently shortened in comparison with the times $T_0$ and $T_1$.

For example, it is assumed that the time constant for charging the liquid crystal display panel is $T_0/6$. Also assuming that the full swing range is 5 V, an error rate of the charged voltage in the charging over the period $T_0$ is about 0.3%, namely 15 mV. Here, if the voltage interval of one gray scale level, namely 5 V/32 (=0.15 V) is charged during a period $T_0/3$ under the same charging time constant, the error rate of the charged voltage is about 13%, namely, about 20 mV. Accordingly, the time period $T_1$ and $T_2$ can be made to $2T_0/3$ and $T_0/3$, respectively.

In the above mentioned operation, the period in which two transfer gates of the transfer gates $TG_0$ to $TG_{16}$ are simultaneously in the on condition, is the period $T_2$. Accordingly, the time period in which the two transfer gates are simultaneously turned on so that the current flows through the gray scale level voltage supplies and therefore the electric power is consumed, is shortened to 1/3. If the time constant for charging the liquid crystal display panel is extremely smaller than the time period $T_0$, or if the number of gray scale levels is increased so as to make the voltage interval of each one gray scale level further small, the period of T2 can be further made small, and therefore, the averaged current of the gray scale level voltage supplies can correspondingly further be reduced.

Incidentally, it is a matter of course that when the sub bit $D_{H0}$ is "0", no current flows through the gray scale level voltage supplies. It is sufficient if the output voltage interpolating input Vh is optimized in correspondence with the characteristics of the liquid crystal display panel.

Figure 9:
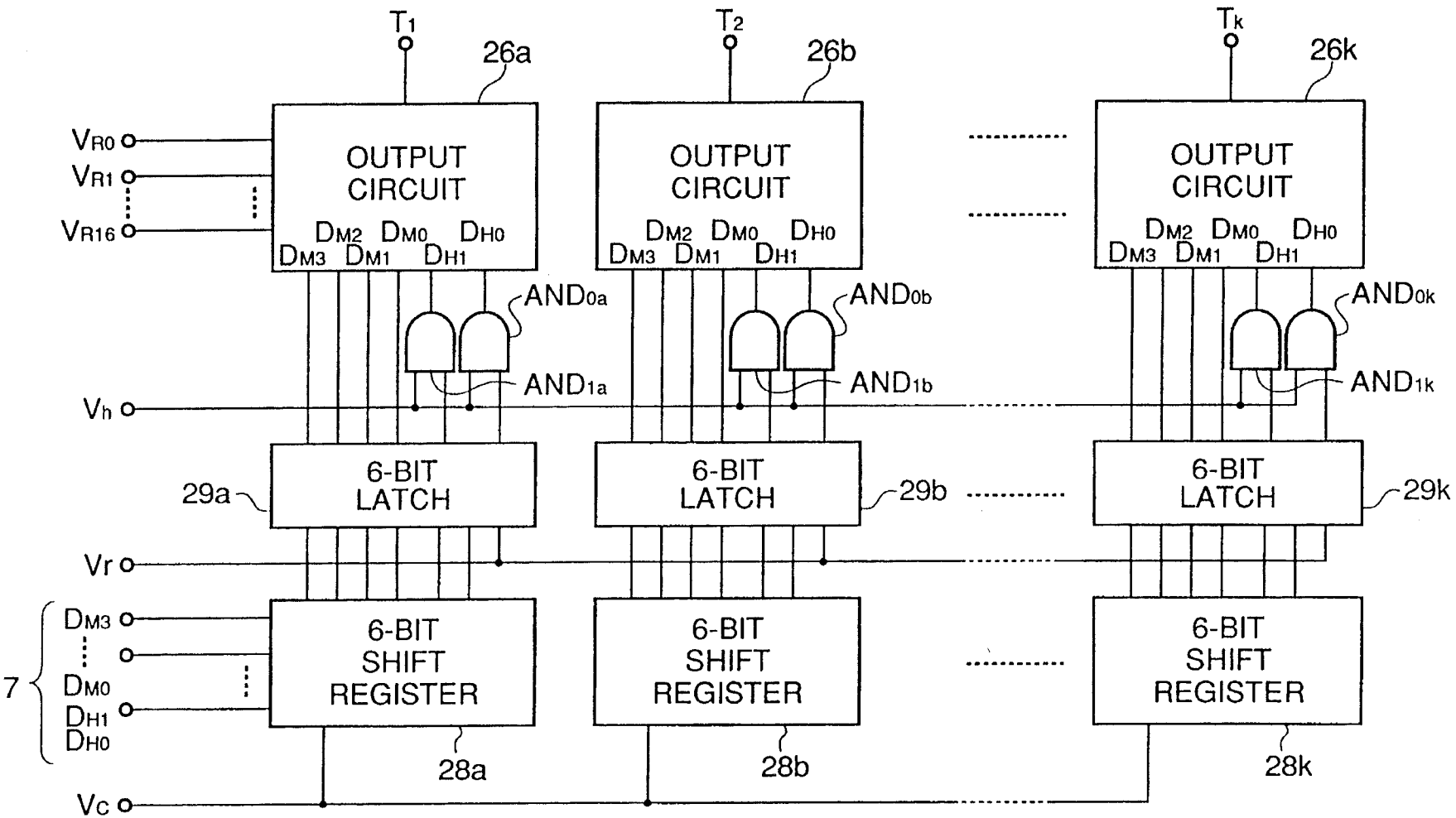
FIG. 9 is a block diagram of a second embodiment of the liquid crystal device driving circuit in accordance with the present invention.

Now, referring to FIG. 9, explanation will be made on a second embodiment of the liquid crystal device driving circuit in accordance with the present invention, which is configured to reduce the current of the gray scale level voltage supplies in accordance with the principle of the tint embodiment, and which can obtain a multiple gray scale increased by one bit, with the same number of external gray scale level voltage supplies. Namely, the image input data is increased from 5 bits to 6 bits, and the gray scale levels of $2^6=64$ are generated with the same number (17) of external gray scale level voltage supplies.

Similarly to the first embodiment, the four most significant bits $D_{M3}$ to $D_{M0}$ of the 6-bit image input data are called the "main bits", and the two least significant bits $D_{H1}$ to $D_{H0}$ of the 6-bit image input data are called the "sub bits".

The shown drive circuit includes "k" stages of 6-bit shift registers 28*a* to 28*k* receiving an image input data from an image data input terminal 7, a corresponding number of 6-bit latches 29*a* to 29*k* each for latching the 6-bit data of a corresponding one of the 6-bit shift registers 28*a* to 28*k*, and a number of AND gates AND1*a* to AND1*k* and AND0*a* to AND0*k* for controlling the output of the interpolating bits on the basis of an output voltage interpolating input Vh, and a number of output circuits 26*a* to 26*k* each receiving external gray scale level voltages $V_{R0}$. $V_{R1}, \ldots, V_{R16}$ for generating voltages of 64 gray scale levels.

Figure 10:
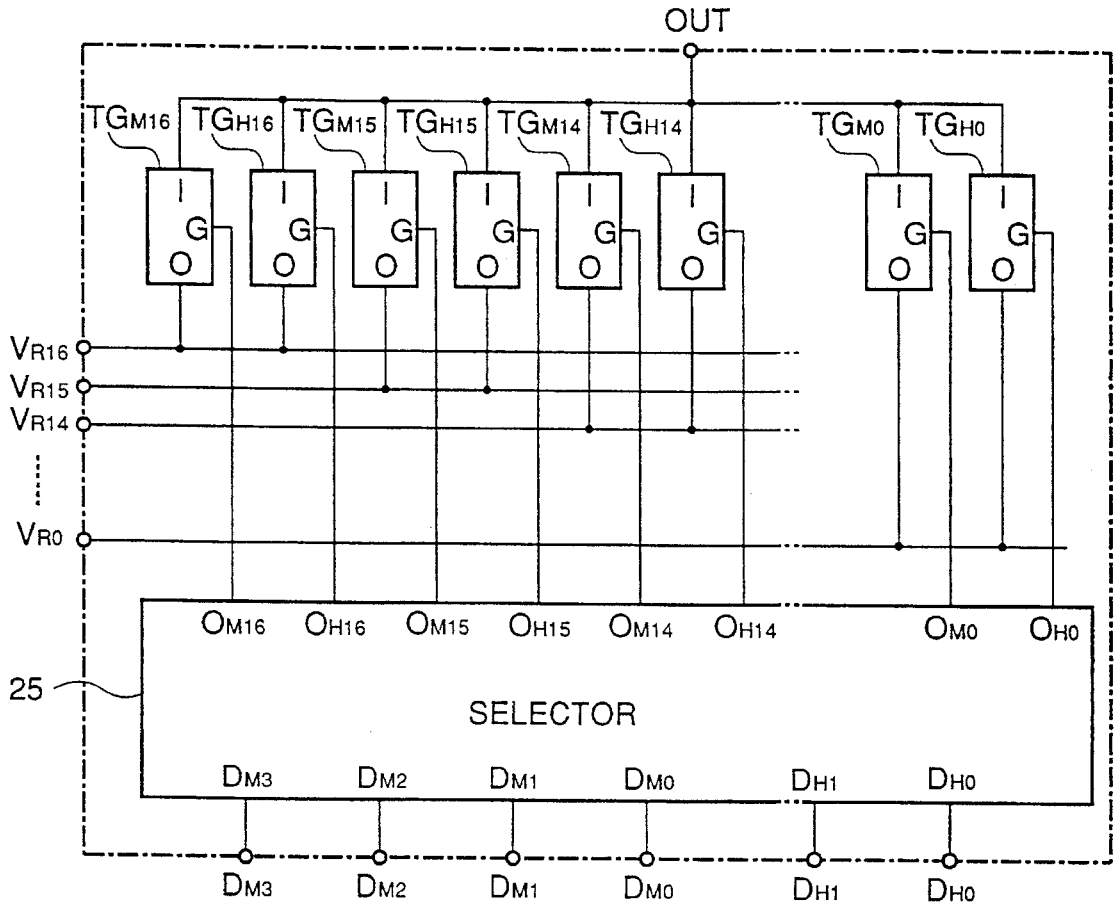
FIG. 10 is a detailed circuit diagram of the output circuit included in the liquid crystal device driving circuit shown in FIG. 9.
Figure 11:
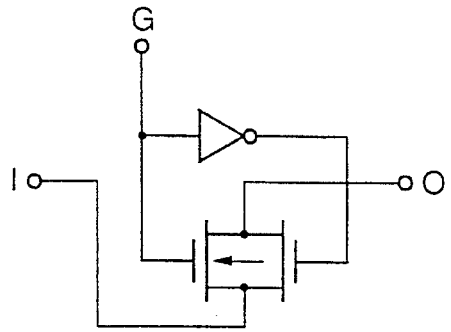
FIG. 11 is a circuit diagram illustrating one example of a transfer gate.

Each of the output circuits 26*a* to 26*k* has a construction as shown in FIG. 10. Each gray scale level voltages $V_{Rn}$ is connected to one end of a main transfer gate TGMn and one end of a sub transfer gate TGHn in parallel, and the other end of all the transfer gates are connected in common to an output terminal OUT ($T_1$ to $T_k$). FIG. 11 shows an detailed logic circuit of the transfer gate used as the main transfer gate TGMn and the sub transfer gate TGHn. One N-channel transistor NMOS and a P-channel transistor PMOS are connected in parallel to each other between an input "I" and an output "O", and a gate signal G is supplied to a gate of the N-channel transistor NMOS and through an inverter INV to a gate of the P-channel transistor PMOS. Thus, when the gate signal G is at a high level, both of the N-channel transistor NMOS and the P-channel transistor PMOS are turned on, namely, the transfer gate is turned on. When the gate signal G is at a low level, both of the N-channel transistor NMOS and the P-channel transistor PMOS are turned off, namely, the transfer gate is turned off.

Figure 12:
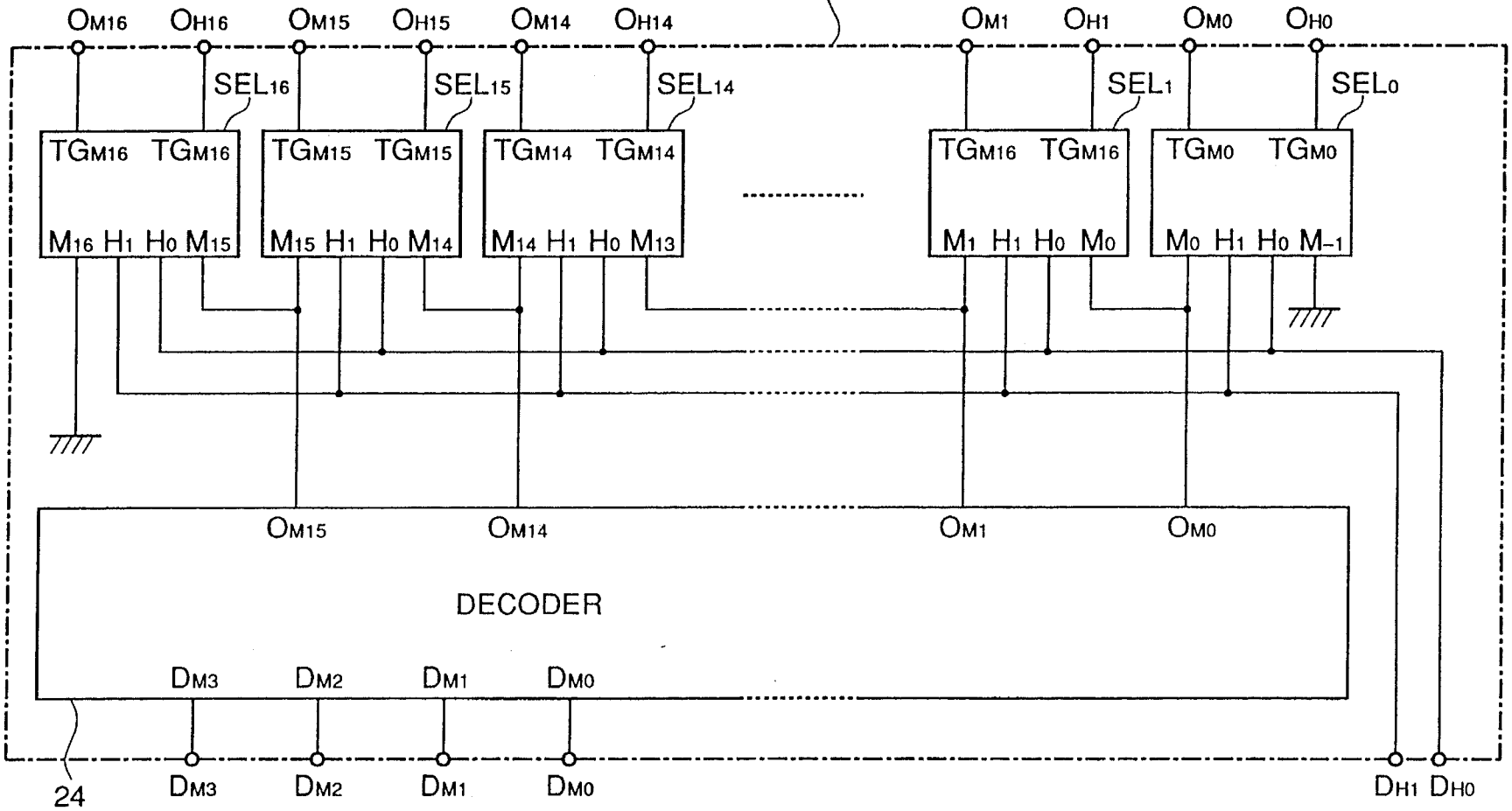
FIG. 12 is a detailed block diagram showing the selector circuit in the liquid crystal device driving circuit shown in FIG. 9.
Figure 13:
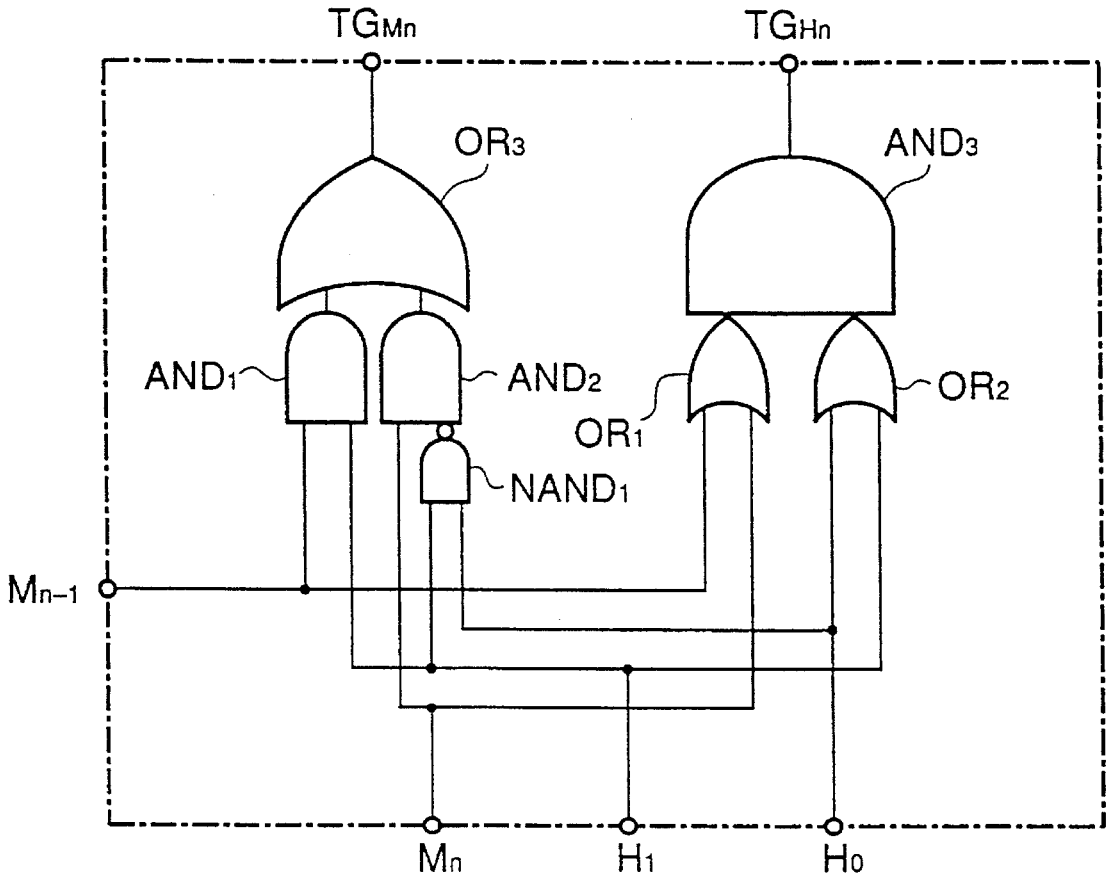
FIG. 13 is a logic diagram showing a specific circuit of the control circuit included in the selector circuit shown in FIG. 12.

The main transfer gates $TGM_0$ to $TGM_{16}$ and the sub transfer gates $TGH_0$ to $TGH_{16}$ are on-off controlled by a selector circuit 25. FIG. 12 shows a detailed block diagram of the selector circuit 25. The selector circuit 25 includes a decoder 24 receiving the main bits $D_{M3}$ to $D_{M0}$ for generating 16 selection signals $OM_{15}$ to $OM_0$, similarly to the first embodiment, and control circuits $SEL_0$ to $SEL_{16}$ which correspond To the control circuits $SE_0$ to $SE_{16}$ of the first embodiment, but which receive the sub bits $D_{H1}$ and $D_{H0}$. A specific circuit of each of the control circuits $SEL_0$ to $SEL_{16}$ which is shown in FIG. 13, and its truth table is shown in FIG. 14. Each of the control circuits $SEL_0$ to $SEL_{16}$ includes three OR gates $OR_1$, $OR_2$ and $OR_3$, three AND gates $AND_1$, $AND_2$ and $AND_3$ and one NAND gate $NAND_1$, connected as shown in FIG. 13.

First, operation of the output circuits 26*a* to 26*k* will be described. All the main transfer gates $TGM_0$ to $TGM_{16}$ and all the sub transfer gates $TGH_0$ to $TGH_{16}$ have the same on-resistance, respectively. For example, this can be realized if all the transfer gates have the same construction and the same size when the liquid crystal device driving circuit is implemented on a silicon substrate.

Figure 15:
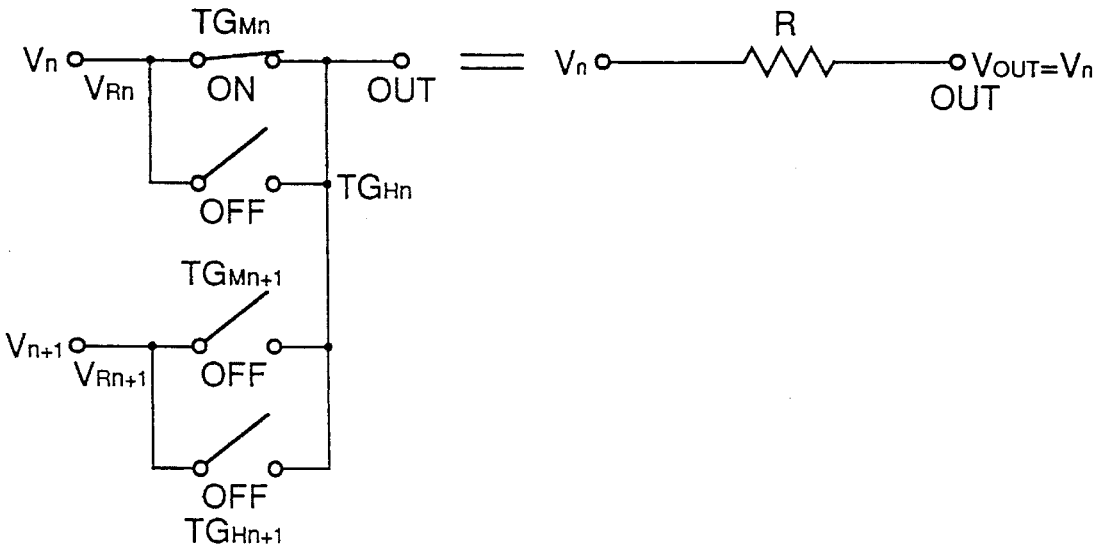
FIGS. 15, 16, 17 and 18 are equivalent circuits showing various conditions of the output circuit included in the liquid crystal device driving circuit shown in FIG. 9.

A ratio between the on-resistance of the main transfer gates $TGM_0$ to $TGM_{16}$ and the on-resistance of the sub transfer gates $TGH_0$ to $TGH_{16}$ is set to be 1:2. At this time, if the sub bits $(D_{H1}, D_{H0})=(0, 0)$, the output TGHn of the control circuits $SEL_0$ to $SEL_{16}$ are "0", and the output TGMn is Mn, as will be understood from the truth table of FIG. 14. Therefore, only one transfer gate TGMn selected in accordance with the content of the main bits $D_{M3}$ to $D_{M0}$ is selected, so that Vn is outputted from the output OUT. An equivalent circuit of the output circuit in this condition is shown in FIG. 15. In FIG. 15 and in succeeding FIGS. 16 to 18, the resistance value "R" shows the on-resistance of the main transfer gates $TGM_0$ to $TG_{M16}$ and the resistance value "2R" shows the on-resistance of the sub transfer gates $TGH_0$ to $TGH_{16}$.

Figure 16:
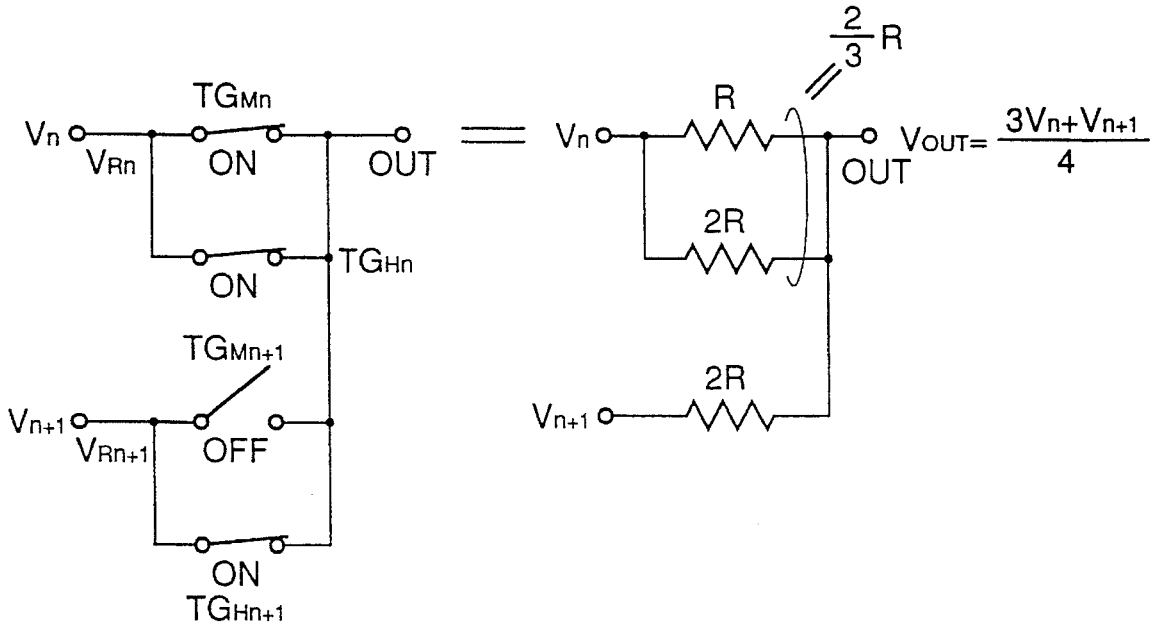

Next, function of the sub bits $D_{H1}$ and $D_{H0}$ will be described. Firstly, assume that the output OMn of the decoder 24 is selected or activated in accordance with the content of the main bits $D_{M3}$ to $D_{M0}$. At this time, if the sub bits $(D_{H1}, D_{H0})=(0, 1)$, the outputs TGMn and TGHn of the control circuit $SEL_n$ are selected, and also, the output $TGH_{(n+1)}$ of the control circuit $SEL_{(n+1)}$ is selected, as will be understood from the truth table of FIG. 14. At this time, an equivalent circuit of the output circuit becomes as shown in FIG. 16. Namely, the output voltage of $\{3\ V_n+V_{(n+1)}\}/4$ is outputted.

Figure 17:
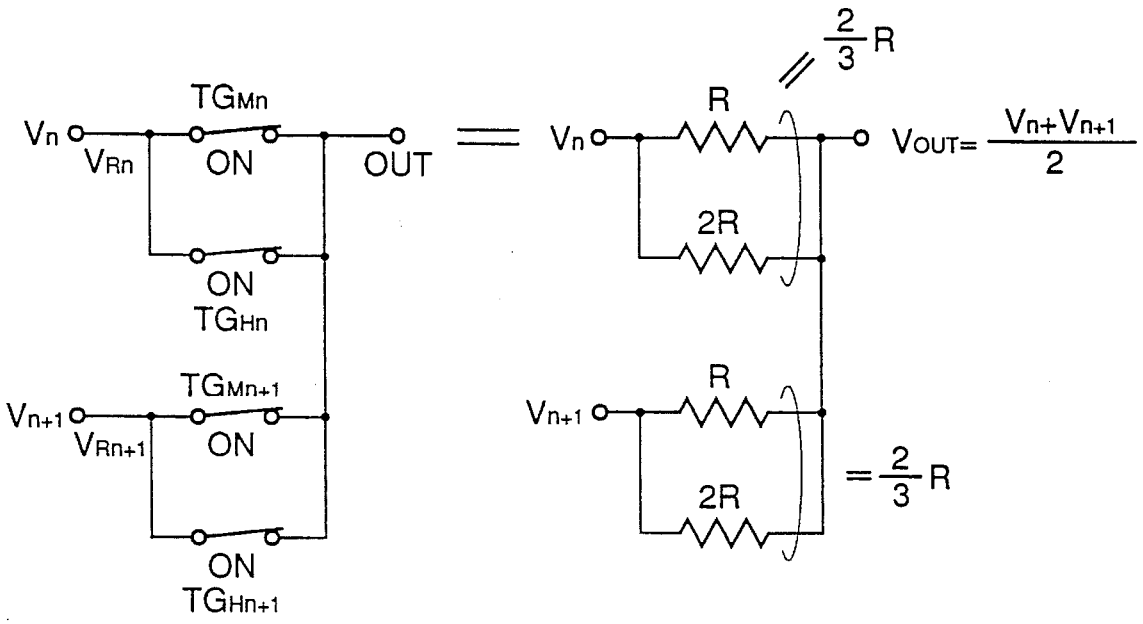

If the sub bits $(D_{H1}, D_{H0})=(1, 0)$, the outputs TGMn and TGHn of the control circuit $SEL_n$ are selected, and also, the outputs $TGM_{(n+1)}$ and $TGH_{(n+1)}$ of the control circuit $SEL_{(n+1)}$ are selected, as will be understood from the truth table of FIG. 14. In this condition, an equivalent circuit of the output circuit becomes as shown in FIG. 17. Namely, the output voltage of $\{V_n+V_{(n+1)}\}/2$ is outputted.

Figure 18:
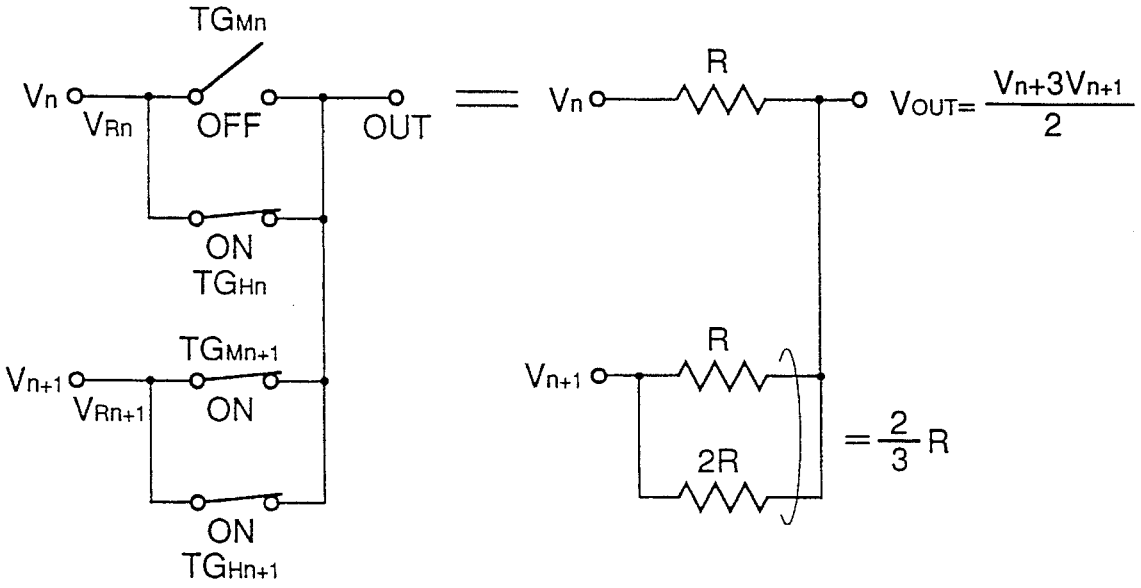

If the sub bits $(D_{H1}, D_{H0})=(1, 1)$, the output TGHn of the control circuit $SEL_n$ is selected, and also, the outputs $TGM_{(n+1)}$ and $TGH_{(n+1)}$ of the control circuit $SEL_{(n+1)}$ are selected, as will be understood from the truth table of FIG. 14. At this time, an equivalent circuit of the output circuit becomes as shown in FIG. 18. Namely, the output voltage of $\{V_n+3\ V_{(n+1)}\}/4$ is outputted.

As mentioned above, a multiple of different voltages can be generated by connecting the main transfer gates $TGM_0$ to $TGM_{16}$ and the sub transfer gates $TGH_0$ to $TGH_{16}$ in parallel to the gray scale level voltage supplies, and by turning on these transfer gates in various different combinations.

Now, the overall operation of the second embodiment of the liquid crystal device driving circuit will be described. Similarly to the first embodiment, the image input data $D_{M3}$ to $D_{M0}$ and $D_{H1}$ and $D_{H0}$ are transferred through the 6-bit shift registers 28*a* to 28*k*, and then latched into the 6-bit latches 29*a* to 29*k* in response to the latch pulse Vr. In addition, the AND gates $AND_{0a}$ to $AND_{0k}$ and $AND_{1a}$ to $AND_{1k}$ are controlled by the output voltage interpolating input Vh, so as to control application of the sub bits $D_{H1}$ and $D_{H0}$ to the output circuit. Thus, the relation between the image data and the output voltage as shown in the tables of FIGS. 19 and 20 can be obtained. Accordingly, operation similarly to the first embodiment can be performed, and the average current flowing through the gray scale level voltage supplied can be effectively reduced. On the other hand, if the number of the transfer gates is increased, it is possible to increase the number of gray scale level voltages.

The invention has thus been shown and described with reference to the specific embodiments. However, it should be noted that the present invention is in no way limited to the details of the illustrated structures but changes and modifications may be made within the scope of the appended claims.

We claim:

1. A liquid crystal display driving circuit comprising:

a plurality of switching means each having a first end connected in common to a source line of a liquid crystal display panel and a second end connected to a plurality of driving voltages, respectively, for supplying a different voltage to said source line, and control means receiving an image input data for selectively turning on said switching means, for realizing a multiple gray scale display, the control means including means, based on said image input data, for turning on only one switching means selected from said plurality of switching means during a first partial period of one horizontal display period, and for simultaneously turning on at least two switching means selected from said plurality of switching means during a second partial period of said one horizontal display period, said at least two switching means including said one switching means turned on during the first partial period, said second partial period being different from said first partial period and following said first partial period.

2. A liquid crystal display driving circuit according to claim 1, wherein each of said switching means includes a plurality of switching elements, and wherein when said plurality of switching means are selected, said control means controls, on the basis of the image input data, a combination of switching elements to be turned on included in said plurality of selected switching means.

3. A liquid crystal display driving circuit according to claim 1, wherein said second partial period is shorter than that of said first partial period and that of said one horizontal display period.

4. A liquid crystal display driving circuit according to claim 3, wherein said first partial period has a duration of ⅔ of that of said one horizontal display period and said second partial period has a duration of approximately ⅓ of that of said one horizontal display period.

5. A liquid crystal display driving circuit according to claim 1, wherein during the first partial period, only said one switching means is selected for selecting a value adjacent a predetermined target voltage value and is turned on, and wherein, during the second partial period, said one switching means or at least some of said plurality of switching means are simultaneously turned on such that said target voltage value is obtained.

6. A liquid crystal display driving circuit according to claim 1, wherein said only one switching means turned on during the first partial period is selected by a most significant bit (MSB) portion of the image input data when a least significant bit (LSB) portion of the image input data is a predetermined value.

7. A liquid crystal display driving circuit comprising:

a plurality of switching means each having a first end connected in common to a source line of a liquid crystal display panel and a second end connected to a plurality of driving voltages, respectively, for supplying a different voltage to said source line, and control means receiving an image input data for selectively turning on said switching means, for realizing a multiple gray scale display, the control means including selection means for selecting one switching means for turning on or a plurality of switching means from said plurality of switching means to be simultaneously turned on, and timing control means for maintaining said one switching means in an on condition during one display period when said one switching means is selected by said selection means, said timing control means operating, when said plurality of switching means are selected by said selection means, to turn on only said one switching means of said plurality of switching means during a first partial period of one horizontal display period, and then to simultaneously turn on at least two switching means of said plurality of switching means during a second partial period of said one horizontal display period, said at least two switching means including said one switching means turned on during the first partial period, said second partial period being different from said first partial period and following said first partial period.

8. A liquid crystal display driving circuit claimed in claim 7 wherein each of said switching means includes a plurality of switching elements, and wherein when said plurality of switching means are selected by said selection means, said control means controls, on the basis of the image input data, a combination of switching elements to be turned on included in said plurality of selected switching means.

9. A liquid crystal display driving circuit according to claim 7, wherein said second partial period is shorter than that of said first partial period and that of said one horizontal display period.

10. A liquid crystal display driving circuit according to claim 9, wherein said first partial period has a duration of ⅔ of that of said one horizontal display period and said second partial period has a duration of approximately ⅓ of that of said one horizontal display period.

11. A liquid crystal display driving circuit according to claim 7, wherein during the first partial period, only said one switching means is selected for selecting a value adjacent a predetermined target voltage value and is turned on, and wherein, during the second partial period, said one switching means or at least some of said plurality of switching means are simultaneously turned on such that said target voltage value is obtained.

12. A liquid crystal display driving circuit according to claim 7, wherein said only one switching means turned on during the first partial period is selected by a most significant bit (MSB) portion of the image input data when a least significant bit (LSB) portion of the image input data is a predetermined value.

13. A liquid crystal display driving circuit comprising:

a plurality of transfer gates each having a first end connected in common to a source line of a liquid crystal display panel and a second end connected to a plurality of driving voltages, respectively, for supplying a different voltage to the source line, and a control circuit receiving an image input data for selectively turning on the transfer gates, for realizing a multiple gray scale display, said control circuit for turning on only one transfer gate selected from the plurality of transfer gates during a first partial period of one horizontal display period, and then, for simultaneously turning on at least two transfer gates which are selected from the plurality of transfer gates during the remaining period of said one horizontal display period, said at least two transfer gates including the transfer gate selected during the first partial period.

14. A liquid crystal display driving circuit according to claim 13, wherein said second partial period is shorter than that of said first partial period and that of said one horizontal display period.

15. A liquid crystal display driving circuit according to claim 14, wherein said first partial period has a duration of ⅔ of that of said one horizontal display period and said second partial period has a duration of approximately ⅓ of that of said one horizontal display period.

16. A liquid crystal display driving circuit according to claim 13, wherein during the first partial period, only said one transfer gate is selected for selecting a value adjacent a predetermined target voltage value and is turned on, and wherein, during the remaining period, said one transfer gate or said at least two transfer gates are simultaneously turned on such that said target voltage value is obtained.

17. A liquid crystal display driving circuit according to claim 13, Wherein said only one transfer gate turned on during the first partial period is selected by a most significant bit (MSB) portion of the image input data when a least significant bit (LSB) portion of the image input data is a predetermined value.

18. A driving circuit comprising:

an output terminal;

a plurality of input terminals receiving a plurality of driving voltages, respectively;

a plurality of switching circuits each having a first node connected to said output terminal, a second node connected to a respective one of said input terminals and a control node, each of said switching circuits being rendered conductive when said control node takes an active level to thereby form a conductive path between said first and second nodes; and a control circuit having a plurality of output nodes each connected to said control node of a respective one of said switching circuits and responding to selection data to produce said active level at only one output node of said plurality of output nodes during a first partial period of one horizontal display period and at least two output nodes of said plurality of output nodes during a second partial period of said one horizontal display period that is different from and follows said first partial period, said at least two output nodes including said one output node having said active level during the first partial period.

19. The driving circuit as claimed in claim 18, wherein said selection data includes main data and subdata, said control circuit including:

a decoder responding to said main data for producing a plurality of decoded signals, one of said decoded signals taking said active level;

first gate means responsive to said subdata for modifying said decoded signals and for producing modified decoded signals during said second partial period, at least two of said modified decoded signals taking said active level; and second gate means supplying said output nodes respectively with said decoded signals during said first partial period and respectively with said modified decoded signals during said second partial period.

20. The driving circuit as claimed in claim 18, wherein said selection data includes main data and subdata, said control circuit including:

a decoder responding to said main data for producing a plurality of decoded signals, one of said decoded signals taking said active level.

21. The driving circuit as claimed in claim 20, wherein said control circuit further includes:

first gate means responsive to said subdata for modifying said decoded signals and for producing modified decoded signals during said second partial period, at least two of said modified decoded signals taking said active level.

22. The driving circuit as claimed in claim 21, wherein said control circuit further includes:

second gate means supplying said output nodes respectively with said decoded signals during said first partial period and respectively with said modified decoded signals during said second partial period, said second gate means comprising a plurality of transfer gates.

23. A liquid crystal display driving circuit according to claim 18, wherein said only one output node turned on during the first partial period is selected by a most significant bit (MSB) portion of the selection data when a least significant bit (LSB) portion of the selection data is a predetermined value.

* * * * *